US007415815B2

(12) United States Patent
Vodonos

(10) Patent No.: US 7,415,815 B2
(45) Date of Patent: Aug. 26, 2008

(54) TUBE DISPENSING MAGAZINE DEVICE AND METHOD

(75) Inventor: Dmitry Yefimovich Vodonos, Branford, CT (US)

(73) Assignee: Conopco, Inc., Englewood Cliffs, NJ (US)

( * ) Notice: Subject to any disclaimer, the term of this patent is extended or adjusted under 35 U.S.C. 154(b) by 346 days.

(21) Appl. No.: 11/156,782

(22) Filed: Aug. 1, 2005

(65) Prior Publication Data

US 2007/0023445 A1 Feb. 1, 2007

(51) Int. Cl.
*B65B 1/04* (2006.01)

(52) U.S. Cl. ..... 53/473; 53/250; 221/304

(58) Field of Classification Search ..... 53/249, 53/250, 469, 473; 221/205, 304
See application file for complete search history.

(56) References Cited

U.S. PATENT DOCUMENTS 3,082,908 A 3/1963 Ingham, Jr.
3,430,810 A 3/1969 Baller et al.
3,452,505 A * 7/1969 Hoag ..... 53/452
3,458,086 A * 7/1969 Strohmeier ..... 221/201
3,545,168 A * 12/1970 Day ..... 53/469
3,713,563 A 1/1973 Dickensheets et al.
3,743,135 A 7/1973 Brumley
3,757,994 A 9/1973 Skoetsch
4,063,629 A 12/1977 Gordon
4,063,633 A * 12/1977 Hall ..... 198/455
4,201,313 A * 5/1980 Kirsch ..... 221/195
4,232,800 A 11/1980 Martin et al.
4,239,068 A 12/1980 Maruo
4,466,229 A 8/1984 Gino
4,669,633 A 6/1987 Tennent
4,860,922 A * 8/1989 Malservisi et al. ..... 221/196
4,913,315 A 4/1990 Wagner
4,939,884 A * 7/1990 Peters ..... 53/284
5,335,822 A 8/1994 Kasper
5,540,315 A 7/1996 Haiki et al.
5,799,824 A * 9/1998 Gasiel ..... 221/298
6,311,831 B1 * 11/2001 van der Griendt et al. ..... 198/487.1
6,732,486 B2 * 5/2004 Saint-Ramon et al. ..... 53/250
7,219,794 B2 * 5/2007 Perazzo et al. ..... 198/861.1

* cited by examiner

*Primary Examiner*—Louis K Huynh
(74) *Attorney, Agent, or Firm*—Milton L. Honig

(57) ABSTRACT

A magazine and tube dispensing method is provided. The magazine includes a receiving compartment for temporarily receiving unfilled tubes intended for filling with a flowable product, the compartment being formed with a movable outer rail wall. A gate assembly downstream from the receiving compartment includes a constriction passageway formed between a lateral inner wall and a lateral member wall allowing downward gravity feed of tubes only in a single file. The lateral member wall is movable in a direction toward or away from the lateral inner wall and integrally movable as a member of the outer rail wall, thereby adjusting a cross-sectional dimension of the passageway to accommodate processing of different diameter tubes.

8 Claims, 2 Drawing Sheets

TUBE DISPENSING MAGAZINE DEVICE AND METHOD

BACKGROUND OF THE INVENTION

1. Field of the Invention

The invention concerns a tube dispensing magazine readily reconfigured to accept different sized diameter tubes and a method for packaging flowable products.

2. The Related Art

Tube dispensing magazines are found at upstream locations in tube filling production lines. Empty cylindrical tubes capped at one end and open on an opposite end are placed in the magazine awaiting individual downstream transfer.

U.S. Pat. No. 3,713,563 discloses cylindrical piece parts which descend under their own weight down an incline surface of a supply hopper to a discharge opening. To prevent clogging of the opening, a sweeper blade is cyclically passed over the opening to break up piece part accumulation at that opening.

U.S. Pat. No. 3,743,135 discloses an apparatus for dispensing a preselected number of generally cylindrical articles such as pens or pencils through a hopper having two facing vertical walls and two facing walls that converge downwardly. Lower edges of the walls form an opening at the bottom for the hopper such that only one article at a time can pass through the opening.

U.S. Pat. No. 4,466,229 reports a process and machine for packaging individual drinking straws. The machine includes a hopper with a hinged front wall flanked by two side walls and held by a connecting rod. A bottom of the hopper features a thin platform with a raised front edge exhibiting an alternating longitudinal motion which pushes straws out of the hopper and ensures formation of a tight and compact line of straws.

U.S. Pat. No. 4,669,633 describes a machine for insertion of elongated cylindrical objects such as pens into a rapidly moving stream of envelopes. A supply hopper for the objects includes a trough feeding the objects to a delivery station and a horizontally reciprocating assembly which takes one object at a time from the trough and feeds into an open envelope.

Often a filling line must service production of many different sized packaged products. Changeover from one size of tube to another must be rapid to avoid production delays. Traditional tube dispensing magazines utilize a constriction passageway funneling a multi rowed array of tubes into a single line. Walls of the passageway can be adjusted but only at the expense of stopping the filling process. The mechanism for wall adjustment is tied to other process equipment within the line. Changeover to a different diameter tube requires relative adjustment to every adjacent mechanism. The switch is time consuming and often inaccurate.

The present invention overcomes the problem of long delay in package changeover from filling one size tubing to a different sized one. Production is thereby rendered more efficient.

SUMMARY OF THE INVENTION

A tube dispensing magazine is provided which includes:

a receiving compartment for temporarily receiving a plurality of unfilled tubes intended for being filled with a flowable product, the compartment being formed with a movable outer rail wall;

a gate assembly downstream from the receiving compartment and including a constriction passageway formed between a lateral inner wall and a lateral member wall allowing movement of tubes only in a single file, the lateral member wall being movable in a direction toward or away from the lateral inner wall and being integrally movable as a member of the outer rail wall thereby adjusting a cross-sectional dimension of the passageway to accommodate processing of different diameter tubes.

Further, the outer rail wall may include an adjustable lifting arm member projecting inward within the receiving compartment. The lifting arm member has a lifting arm which can pivot within the receiving compartment to reduce static pressure of tubes above relative to a lowest row of tubes near an upper end of the passageway. A leading edge of the lifting arm functions to constrict the array of tubes traveling downward into the passageway.

Additionally, the magazine includes an actuating member for moving the lifting arm member relative to an interior of the receiving compartment. The actuating member preferably is attached to a surface of the lifting arm member on a wall exterior to the receiving compartment. A particularly preferred embodiment is wherein the actuating member is an air driven piston assembly.

A cradle is placed at a downstream end of the dispensing magazine. The cradle is positioned adjacent an outlet end of the passageway, the cradle shuttling between at least two positions. A first position allows one of the plurality of tubes to be received in the cradle. In a second position, the cradle blocks the outlet end preventing egress of any tube from the passageway.

Further provided is a method for filling tubes including:

(a) providing a tube dispensing magazine including:

a receiving compartment for temporarily receiving a first plurality of unfilled tubes intended for being filled with a flowable product, the compartment being formed with a movable outer rail wall;

a gate assembly downstream from the receiving compartment and including a constriction passageway formed between a lateral inner wall and a lateral member wall allowing movement of tubes only in a single file, the lateral member wall being movable in a direction toward or away from the lateral inner wall and being integrally movable as a member of the outer rail wall thereby adjusting a cross-sectional dimension of the passageway to accommodate processing of different diameter tubes;

(b) loading the receiving compartment with unfilled tubes;

(c) allowing the magazine to feed the unfilled tubes, one tube at a time, to a product filling station downstream from the magazine; and (d) filling each of the unfilled tubes with product.

Further, the method at a time subsequent to filling the first plurality of tubes includes a step of adjusting the cross-sectional dimension of the passageway. This enables the passageway to receive an alternate set of tubes with diameters different from the first plurality of tubes, and loading the magazine with the alternate set of tubes.

BRIEF DESCRIPTION OF THE DRAWING

Further advantages and features of the present invention will become more apparent through consideration of the following drawing in which.

DETAILED DESCRIPTION OF THE INVENTION

Now there is provided a tube dispensing magazine which allows for rapid conversion from one diameter size packaging to another. An operator can accomplish dimensional changes in the passageway of the magazine through readily accessible adjustment means on exterior surfaces of the magazine.

Figure 1:
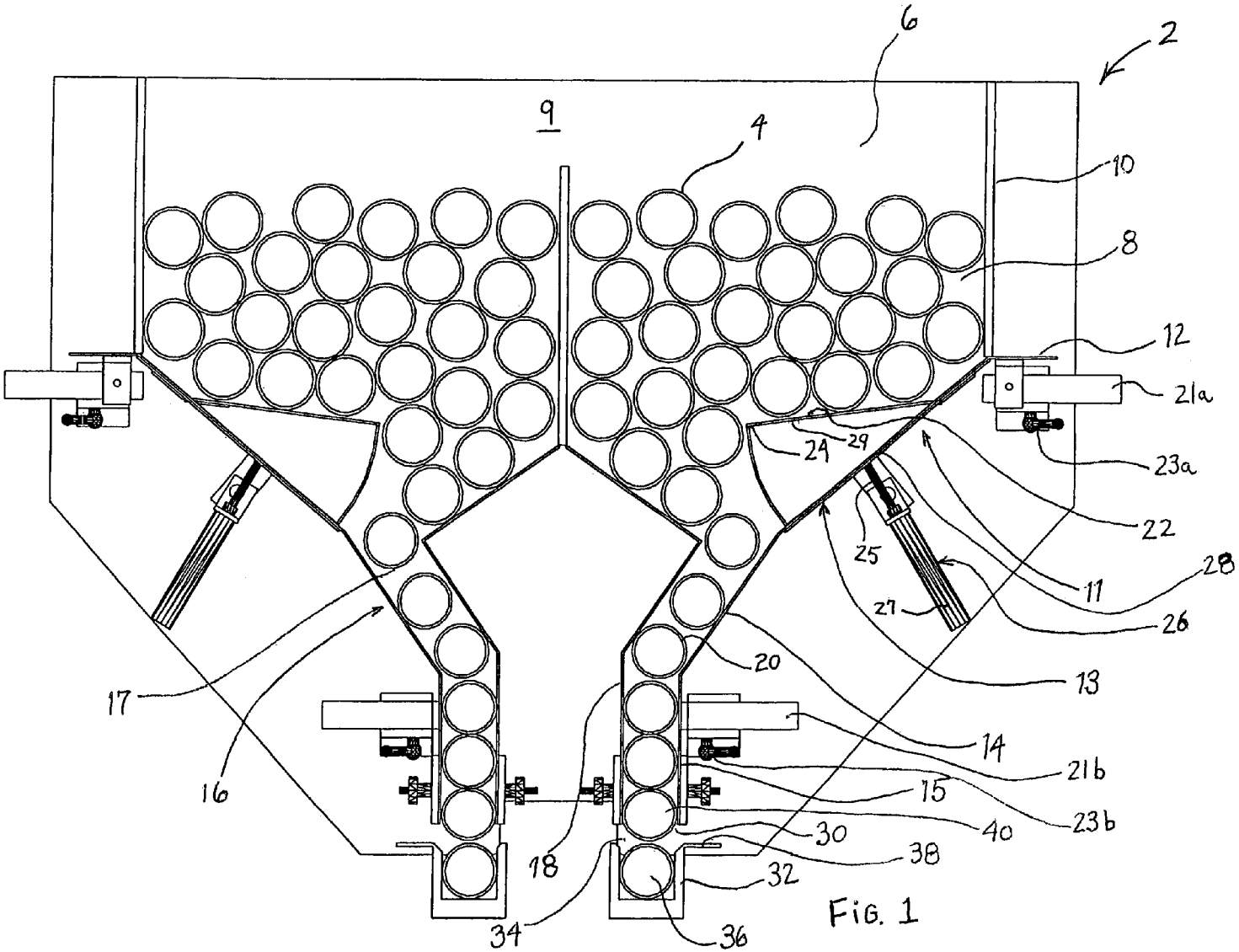
FIG. 1 is a front view of a tube dispensing magazine according to the present invention.

FIG. 1 illustrates the tube dispensing magazine 2 filled with a plurality of empty tubes 4 waiting downstream filling of a product thereinto.

The magazine includes a receiving compartment 6 with an area 8 for temporarily receiving a plurality of unfilled tubes 4. Various liquid or semi-liquid products can be housed therein. Representative but not limiting examples include personal care products such as cosmetic creams and ointments, toothpaste, shower gels, shampoos, and hair conditioners; foods such as peanut butter, tomato paste, anchovy paste, spreads and jellies; and household products such as waxes, polishes, hard surface cleaners, adhesives and caulking materials.

The compartment features a base plate 9 opposite an open front face. Substantially perpendicular to the base plate is a rail system that includes an upper rail 10 and a contiguous movable outer rail wall 11. The upper rail may either be stationary or movable.

The moveable outer rail wall 11 features a wing member 12 oriented substantially orthogonal to upper rail 10 and, in a second plane, is orthogonal to the base plate 9. Wall 11 further includes a lifting arm member 13 joined at an obtuse angle to the wing member 12, an extension member 14, and a lateral wall member 15. The extension member joins together the lifting arm member and lateral wall member into a unitary outer wall.

Downstream from the receiving compartment is a gate assembly 16. This assembly features a constriction passageway 17. An interior lateral wall 18 in combination with lateral wall member 15 form the passageway. Gravity feeds tubes down the passageway forcing them into single file 20.

Lateral wall member 15 is movable in a direction toward or away from the lateral wall 18. Additionally, lateral wall member 15 is integrally movable in tandem with the other members constituting the outer rail wall 11. Movement is facilitated by upper and lower linear guide bearings 21*a* and 21*b*, respectively. Screws 23*a* and 23*b* when loosened permit movement of the respective upper and lower guide bearings in a direction toward or away from the receiving compartment. Cross-sectional dimension of the passageway can be controlled by these adjustment mechanisms to accommodate processing of different diameter tubes.

Lifting arm member 13 features a lifting arm 22 projecting inward and pivotable within the receiving compartment area 8. A leading edge 24 of the lifting arm is positioned to constrict in number the rows of tubes 4 funneling downward into the passageway.

An actuating member 26 actuates inward motion of the arm relative to the interior area 8 of the receiving compartment. In a preferred embodiment, the actuating member 26 is an air driven piston assembly. The assembly features a piston rod 25 and cylinder 27 to house the rod. The cylinder is attached to a wall surface 28 of the lifting arm member 13 exterior to the receiving compartment. The piston rod 25 attaches to an exterior wall surface 29 of arm 22.

Figure 2:
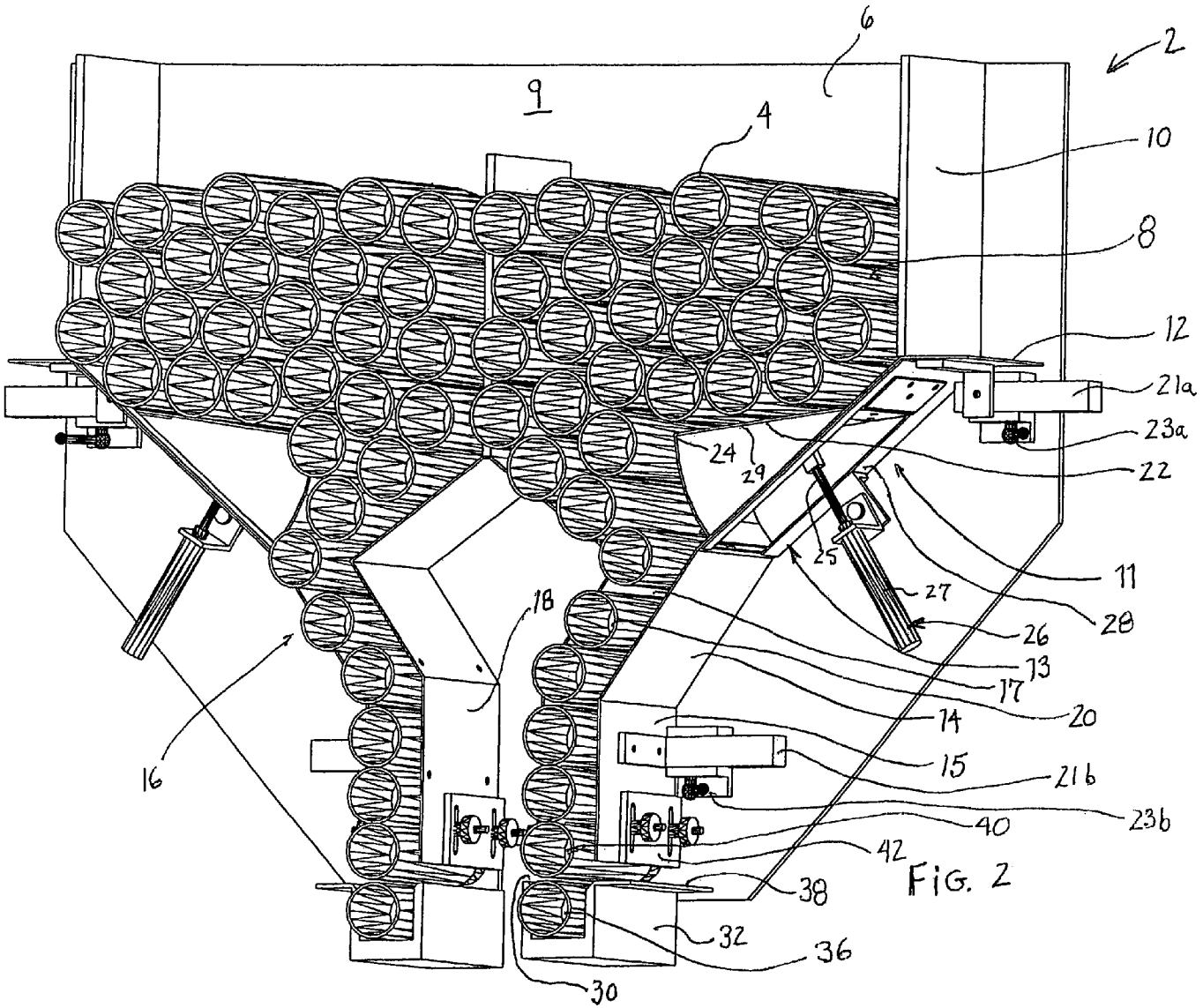
FIG. 2 is a plan perspective view of the magazine shown in FIG. 1.

Passageway 17 includes an outlet end 30 from which tubes exit. A cradle 32 is positioned adjacent the outlet end 30. The cradle shuttles between at least two positions. FIGS. 1 and 2 illustrate the first position 34 which allows one of the plurality of tubes 36 to be received in the cradle. The second position (not shown) of the cradle via shoulder 38 blocks the outlet end 30 thereby preventing egress of a next tube 40 from the passageway. A pair of extension plates 42 are releasably attached one on each of the lateral wall member 15 and lateral wall 18 adjacent the outlet end 30. These plates can be vertically extended or retracted dependent upon tube diameter. They function to insure accurate tube delivery to the cradle.

Downstream from the cradle can be a chute gravity feeding a tube from the cradle to a transport cup on a conveyer belt or rotating wheel. The tube is held upright in the cup on an end which has been pre-capped. The open end of the tube is then transported beneath a nozzle which injects liquid or semi-liquid product within the tube.

Thereafter, the filled tube is transported to a crimping machine which closes the open end. Finally, the filled and crimped tube is forwarded to a downstream packaging line.

Also provided by this invention is a method for filling tubes. This method includes providing a tube dispensing magazine with features aforedescribed. Multiple tubes (e.g. from 5 to 100 or more) capped at one end are loaded into the dispensing magazine each adjacent the other along a lengthwise direction of the tubes. Thereafter, the method includes allowing the magazine to gravity feed the tubes one at a time to a product filling station downstream from the magazine. Finally, the method includes filling each of the plurality of tubes with products.

The term "comprising" is meant not to be limiting to any subsequently stated elements but rather to encompass non-specified elements of major or minor functional importance. In other words the listed steps, elements or options need not be exhaustive. Whenever the words "including" or "having" are used, these terms are meant to be equivalent to "comprising" as defined above.

What is claimed is:

1. A method for filling tubes comprising:

(a) providing a tube dispensing magazine comprising:

a receiving compartment for temporarily receiving a first plurality of unfilled tubes intended for being filled with a flowable product, the compartment being formed with a movable outer rail wall;

a gate assembly downstream from the receiving compartment and including a constriction passageway formed between a lateral inner wall and a lateral member wall allowing movement of tubes only in a single file, the lateral member wall being movable in a direction toward or away from the lateral inner wall and being integrally movable as a member of the outer rail wall thereby adjusting a cross-sectional dimension of the passageway to accommodate processing of different diameter tubes;

(b) integrally moving said outer rail wall and said lateral wall member to adjust the cross-sectional dimension of the passageway to accommodate processing of preselected diameter unfilled tubes;

(c) loading the receiving compartment with the preselected diameter unfilled tubes;

(d) allowing the magazine to feed the preselected diameter unfilled tubes, one tube at a time, to a product filling station downstream from the magazine; and (e) filling each of the preselected diameter unfilled tubes with product.

2. The method according to claim 1 wherein at a time subsequent to filling the first plurality of unfilled tubes, adjusting the cross-sectional dimension of the passageway to receive an alternate set of unfilled tubes having diameters different from the first plurality of unfilled tubes, and loading the magazine with the alternate set of unfilled tubes.

3. The method according to claim 1 wherein the first plurality of unfilled tubes are each capped at one end thereof prior to loading into the receiving compartment.

4. The method according to claim 1 wherein the outer rail wall comprises a lifting arm member projecting inward within the receiving compartment.

5. A method according to claim 4 wherein the lifting arm member comprises a lifting arm which is pivotable relative to an interior of the receiving compartment functioning to constrict an array of the unfilled tubes traveling downward into the passageway.

6. A method according to claim 4 wherein the lifting arm member reduces static pressure of tubes above relative to a lowest row of tubes near an upper end of the passageway.

7. The method according to claim 4 further comprising an actuating member attached to a surface of the lifting arm member on a wall exterior to the receiving compartment.

8. The method according to claim 7 wherein the actuating member is an air driven piston assembly.

* * * * *

UNITED STATES PATENT AND TRADEMARK OFFICE

CERTIFICATE OF CORRECTION

PATENT NO. : 7,415,815 B2
APPLICATION NO. : 11/156782
DATED : August 26, 2008
INVENTOR(S) : Vodonos It is certified that error appears in the above-identified patent and that said Letters Patent is hereby corrected as shown below:

On the Title Page, Item (73). This error was found in the Assignee section wherein "Conopco, Inc., Englewood Cliffs, NJ" should have read -- Conopco, Inc., d/b/a Unilever, Englewood Cliff, NJ --.

Signed and Sealed this

Seventh Day of October, 2008

JON W. DUDAS
*Director of the United States Patent and Trademark Office*